United States Patent [19]

Booth

[11] 4,346,901

[45] Aug. 31, 1982

[54] LIVE FIRE THERMAL TARGET

[75] Inventor: Donald W. Booth, Huntsville, Ala.

[73] Assignee: Sperry Corporation, New York, N.Y.

[21] Appl. No.: 247,467

[22] Filed: Mar. 25, 1981

[51] Int. Cl.[3] ..... F41J 1/00; F41J 9/13; F41J 5/08

[52] U.S. Cl. ..... 273/408; 219/548; 219/553; 250/540 R; 273/348

[58] Field of Search ..... 273/348, 408; 219/521, 219/531, 544, 547, 548, 553; 250/495, 504 R; 434/11

[56] References Cited

U.S. PATENT DOCUMENTS 4,240,212 12/1980 Marshall et al. ..... 434/11
4,253,670 3/1981 Moulton et al. ..... 273/348 X
4,260,160 4/1981 Ejnell et al. ..... 273/348 X
4,279,599 7/1981 Marshall et al. ..... 273/348 X

*Primary Examiner*—Anton O. Oechsle
*Attorney, Agent, or Firm*—Howard P. Terry; Richard J. McGrath

[57] ABSTRACT

In a thermal target suitable for live weapons fire, a resistive material is disposed between layers of insulation and screen like continuous electrodes. Portions of insulation are removed at predetermined locations to expose the resistive material and the continuous electrodes are fastened to the exposed resistive material. When an electrical potential is applied to the continuous electrodes the target emits thermal radiation in order to simulate a known thermal image for an infrared sighting device.

8 Claims, 3 Drawing Figures

LIVE FIRE THERMAL TARGET

BACKGROUND OF THE INVENTION

1. Field of the Invention

This invention relates to thermal images for infrared sighting devices and more specifically to a thermal target suitable for live weapons fire.

2. Description of the Prior Art

A technique for simulating the thermal appearance of objects is disclosed in U.S. Patent application Ser. No. 50,578, entitled "Thermal Signature Targets" filed June 21, 1979, U.S. Pat. No. 4,240,212, and assigned to the U.S. Government. In the technique of the referenced application, electrical energy is applied to conductive strips which are attached to a surface of resistive material. The resistive material is shaped in the form of the selected object and the conductive strips are placed to simulate the thermal radiation pattern that the object has been shown to demonstrate.

The fabrication of the above described apparatus is relatively cumbersome and time consuming. Moreover, when the target is used as a live fire target for weapons, projectiles are likely to sever the conductive strips, thereby resulting in a loss of at least a portion of the thermal image. Accordingly, there is a need for a simple and reliable thermal target which can be fabricated easily and which can withstand the rigors of live fire exercises.

SUMMARY OF THE INVENTION

A thermal target well adapted for live weapons fire is fabricated from a sheet of resistive material, layers of insulation, and continuous electrodes fastened to exposed portions of the resistive material. Preferably, portions of the insulating layers are removed at predetermined locations to expose the resistive material. The continuous electrodes are then fastened to the exposed resistive material by sewn stitches, conductive glue, or stables. When an electrical potential is applied to the continuous electrodes, the resistive material causes the target to emit a thermal image.

DESCRIPTION OF THE PREFERRED EMBODIMENTS

Figure 1:
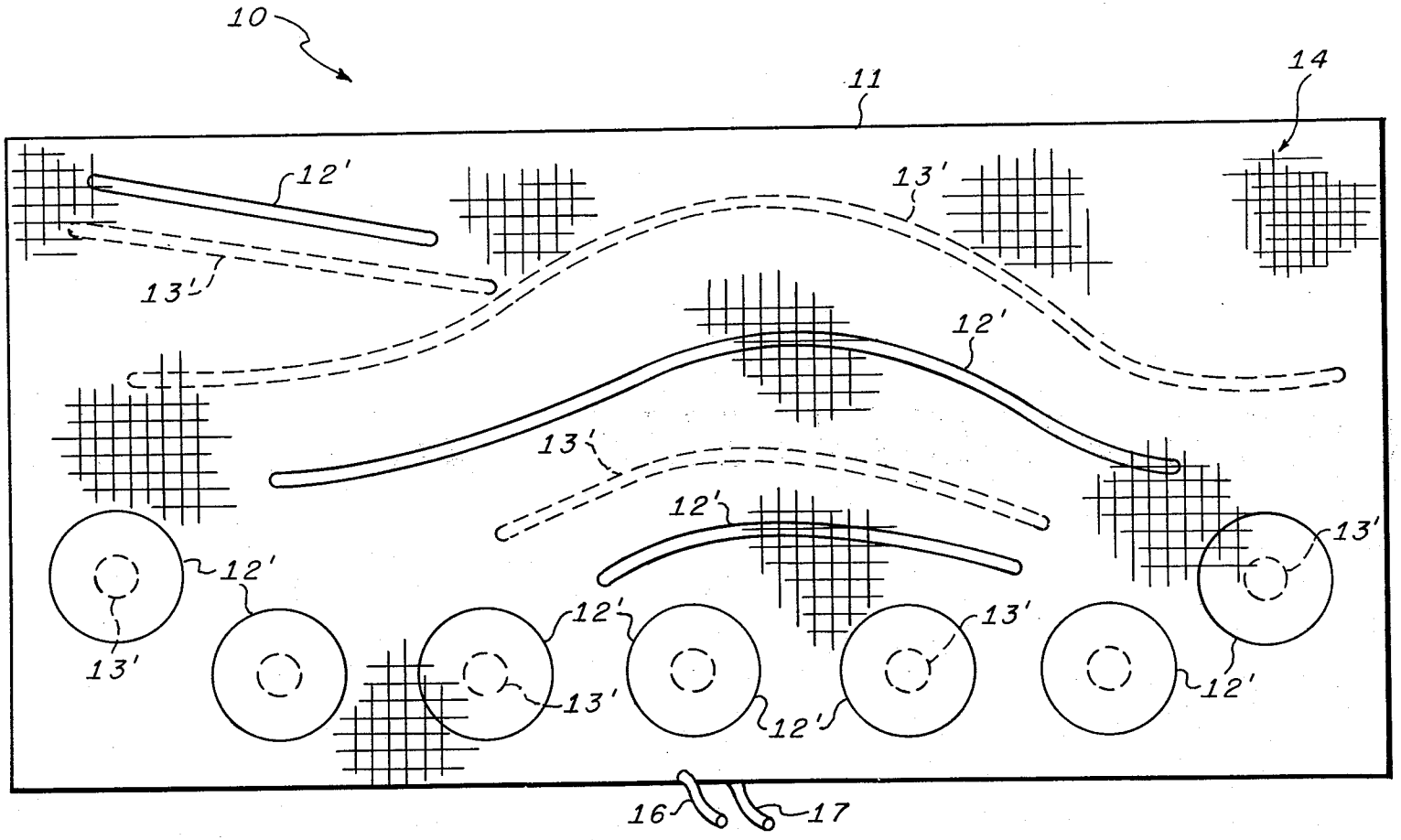
FIG. 1 is a front view of the apparatus of the present invention.
Figure 2:
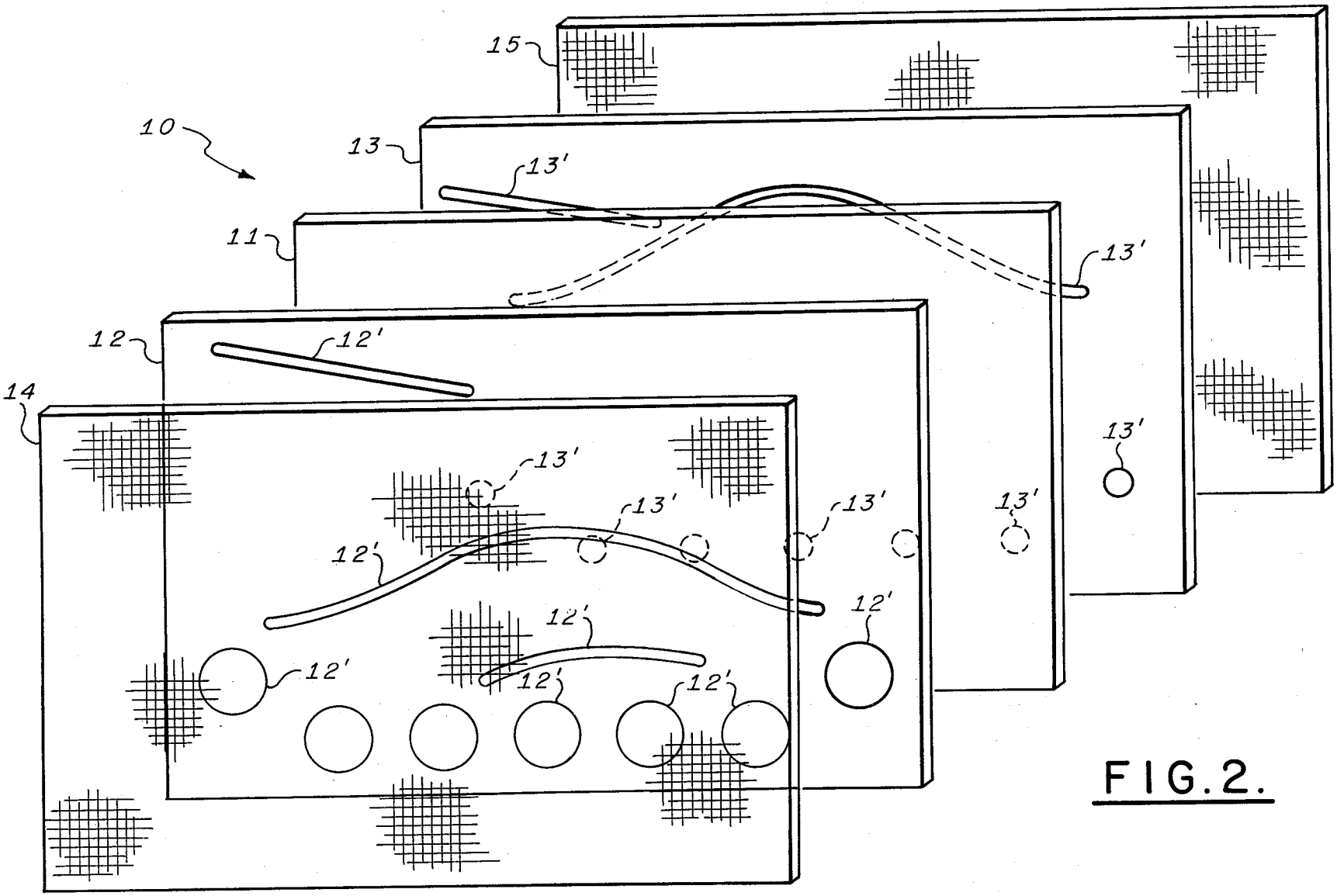
FIG. 2 is an exploded view of the apparatus of FIG. 1.

Referring to FIGS. 1 and 2, a front view and an exploded view respectively illustrate a preferred embodiment of a thermal target 10. The thermal target 10 is preferably fabricated from a sheet of resistive material 11, insulation layers 12 and 13, and continuous electrodes 14 and 15. The resistive material 11 may be of the conductive paper type, for example, Temsheet a product of Armstrong Corporation. The layers of insulation 12, 13 separate the front and rear surfaces of the resistive material from the continuous electrodes 14, 15 except at predetermined locations as hereinafter described. The continuous electrodes are made from electrically conductive screens having approximately 16 wires per inch. In FIGS. 1 and 2, the thermal target 10 simulates a 1/5 scale image of a tank and the target is approximately 2'×4' in size. Preferably, the thermal target 10 is designed to be stapled, wire or rope attached to existing plywood forms that are typically used for daytime target practice.

The thermal target 10 is fabricated by taping or gluing the layers of insulation 12, 13 to the resistive material 11. A template is then placed over the layer of insulation 12 and sections 12' are cut and removed, thereby exposing predetermined front portions of the resistive material 11. The same step is repeated for the layer of insulation 13 in order to remove sections 13' and to expose predetermined rear portions of the resistive material 11. As shown in FIG. 1, the outline of a tank may be simulated by removing the sections or contours 12', 13' from the layers of insulation 12, 13, respectively. The continuous electrodes 14, 15 are placed over the layers of insulation 12, 13 and fastened to the exposed portions of the resistive material 11.

Preferably, the continuous electrodes 14, 15 are fastened to the exposed portions of the resistive material 11 by sewn stitches along the contours 12', 13'. It should be noted, however, that in some instances it may be more economical and efficient to fasten the continuous electrodes 14, 15 to the exposed portion of resistive material 11 with conductive glue or staples. Whatever means of fastening is employed, it must insure good electrical contact between the continuous electrodes 14, 15 and the exposed portions of resistive material 11. Leads 16, 17 are preferably fastened to the lower edge of continuous electrodes 14, 15, respectively , by a solder loop and a brass shim stapled to the continuous electrodes. The thermal target 10, therefore, can be efficiently and cost effectively fabricated in a shop as opposed to assembly in the field which was typical in the prior art.

In operation, an electrical potential of preferably 12 to 28 volts is applied to the leads 16, 17 of the thermal target 10 thus providing a flow of electricity between the front continuous electrode 14, the resistive material 11, and the rear continuous electrode 15. Such a flow of electricity causes the resistive material to emit thermal radiation. The intensity of the thermal radiation emitted is a function of the distance between corresponding contours 12' and 13', i.e., the farther apart the contours the lower the intensity. Thus, the present invention can simulate the known thermal image of an object such as a tank which has portions that often vary in intensity.

It can be appreciated that since the present invention utilizes continuous electrodes 14, 15, the problems associated with the prior art conductive strips are alleviated. The prior art devices are susceptible to losing all or part of the thermal image when the strip conductors are severed by projectiles during live fire exercises, whereas the continuous electrodes of the present invention will provide electrical continuity even after being penetrated numerous times by projectiles. Moreover, the fabrication of the apparatus of the present invention is considerably simplified over that of the prior art and lends itself to mass production techniques.

Figure 3:
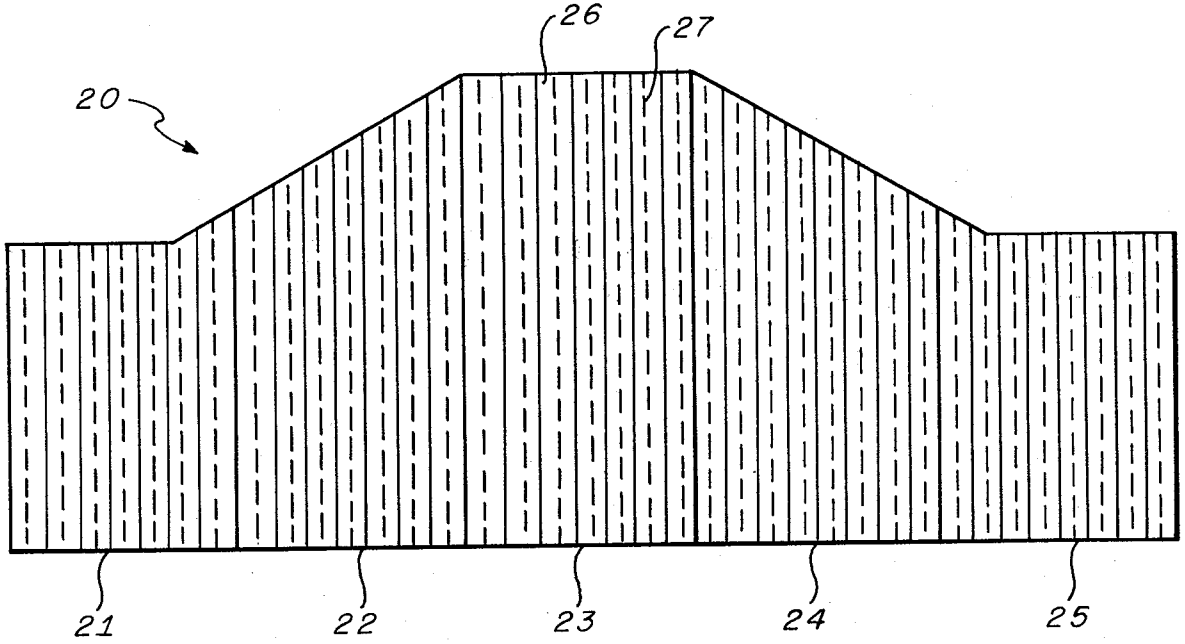
FIG. 3 is a front view of an alternate embodiment of the apparatus of the present invention.

Referring now to FIG. 3 an alternate embodiment of the present invention is provided. The thermal target 20 is comprised of thermal blankets 21, 22, 23, 24, 25 which are fastened to a plywood covered frame of approximately the same size as an actual tank. The thermal blankes 21, 22, 23, 24, 25 include the same resistive material 11, the layers of insulation 12 and 13, and the continuous electrodes 14 and 15 of the thermal target 10 in FIGS. 1 and 2. The thermal blankets, 21, 22, 23, 24, 25, however, do not include the contoured sections 12', 13' of the thermal target 10. Instead the thermal blankets 21, 22, 23, 24, 25 include narrow, straight and uniform sections 26, 27 which are removed from the insulation exposing front and rear portions of the resistive material, thereby providing a location for the fastening of the continuous electrodes. If a 28 volt potential is applied to the continuous electrodes of the thermal target 20, then preferably the uniform sections 26 and 27 are spaced approximately five inches apart. Thus, when an electrical potential is applied to continuous electrodes the thermal target 20 emits a continuous diffused thermal image which simulates a tank and which can be viewed with an infrared sighting device.

While the invention has been described in the preferred embodiments, it is to be understood that the words that have been used are words of description rather than of limitation and that changes within the purview of the appended claims may be made without departing from the true scope and spirit of the invention in its broader aspects.

I claim:

1. A thermal target comprising:

resistive material having at least first and second surfaces;

insulating means disposed upon at least the first and second surfaces of said resistive material and having portions of insulation removed therefrom at predetermined locations; and continuous electrode means disposed upon said insulation means and fastened to at least the first and second surfaces of said resistive material for applying an electrical potential thereto.

2. The apparatus according to claim 1 wherein the portions of insulation removed from said insulating means are used to simulate the thermal image of an object.

3. The apparatus according to claim 1 wherein the insulation is removed from said insulation means in uniform sections.

4. The apparatus according to claims 2 or 3 wherein said continuous electrode means are fabricated from electrically conductive screens.

5. The apparatus according to claim 4 wherein said continuous electrodes are fastened to said resistive material by sewn stitches.

6. The apparatus according to claim 4 wherein said continuous electrodes are fastened to said resistive material by conductive glue.

7. The apparatus according to claim 4 wherein said continuous electrodes are fastened to said resistive material by staples.

8. The method of fabricating a thermal target, comprising the steps of:

placing layers of insulation on at least the first and second surfaces of a resistive material;

removing portions of insulation from the layers of insulation at predetermined locations to expose portions on at least the first and second surfaces of the resistive material; and fastening continuous electrodes to the exposed portions of the resistive material.

* * * * *